US007785152B2

(12) United States Patent
Yi et al.

(10) Patent No.: US 7,785,152 B2
(45) Date of Patent: Aug. 31, 2010

(54) HIGH DENSITY CONNECTOR HAVING TWO-LEVELED CONTACT INTERFACE

(75) Inventors: Chong Yi, Mechanicsburg, PA (US); Kuan-Yu Chen, Harrisburg, PA (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/148,757

(22) Filed: Apr. 22, 2008

(65) Prior Publication Data

US 2009/0264023 A1 Oct. 22, 2009

(51) Int. Cl.
*H01R 24/00* (2006.01)

(52) U.S. Cl. ..... 439/660

(58) Field of Classification Search ..... 439/660, 439/74, 60, 668, 924.1, 701
See application file for complete search history.

(56) References Cited

U.S. PATENT DOCUMENTS 3,101,231 A * 8/1963 Klosterman ..... 439/660
3,497,866 A * 2/1970 Patton, Jr. ..... 439/680
3,868,162 A * 2/1975 Ammon ..... 439/75
3,960,434 A * 6/1976 Soes ..... 439/660
4,737,118 A * 4/1988 Lockard ..... 439/295
5,052,936 A 10/1991 Biechler et al.
5,098,311 A * 3/1992 Roath et al. ..... 439/295
5,161,985 A * 11/1992 Ramsey ..... 439/74
5,295,843 A * 3/1994 Davis et al. ..... 439/108
5,306,196 A * 4/1994 Hashiguchi ..... 439/607
5,310,357 A * 5/1994 Olson ..... 439/346
5,387,134 A * 2/1995 Bryce et al. ..... 439/660
5,498,167 A * 3/1996 Seto et al. ..... 439/74
5,599,192 A * 2/1997 Olson ..... 439/65
5,882,212 A * 3/1999 McHugh et al. ..... 439/74
5,902,136 A * 5/1999 Lemke et al. ..... 439/74
5,904,581 A 5/1999 Pope et al.
5,906,518 A * 5/1999 Sun ..... 439/660
5,921,787 A * 7/1999 Pope et al. ..... 439/74
5,971,809 A * 10/1999 Ho ..... 439/660
6,010,369 A * 1/2000 Itabashi et al. ..... 439/660
6,068,518 A 5/2000 McEuen
6,162,081 A * 12/2000 Commerci et al. ..... 439/287
6,241,558 B1 * 6/2001 Mosquera ..... 439/660
6,454,610 B1 * 9/2002 Yu ..... 439/660

(Continued)

*Primary Examiner*—T C Patel
*Assistant Examiner*—Vladimir Imas
(74) *Attorney, Agent, or Firm*—Ming Chieh Chang; Wei Te Chung; Andrew C. Cheng

(57) ABSTRACT

A terminal arrangement in an electrical connector including: an array of terminal pairs arranged along a first direction, each terminal pair comprising a first terminal (5) and a second terminal (6), each of the first terminal and the second terminal having a portion angled toward the other terminal, a connecting end (51, 61) continuing the angled portion, and a terminating end (52, 62) opposite the connecting end, the connecting ends of the first and second terminals of each terminal pair being substantially aligned to each other in a second direction perpendicular to the first direction, the connecting end of the first terminal having a mating face (511) facing away from the second terminal, the connecting end of the second terminal having a mating face (611) facing toward the first terminal, the mating faces of the first and second terminals being spaced a distance from each other in the second direction. An electrical connector (100) and a connector system including such a terminal arrangement are also disclosed.

4 Claims, 14 Drawing Sheets

U.S. PATENT DOCUMENTS

| | | | | |
|---|---|---|---|---|
| 6,540,529 | B1 * | 4/2003 | Yu | 439/74 |
| 6,729,890 | B2 * | 5/2004 | Shin | 439/74 |
| 6,837,748 | B2 * | 1/2005 | Aldridge | 439/660 |
| 7,104,848 | B1 | 9/2006 | Chou et al. | |
| 7,217,158 | B2 * | 5/2007 | Shimizu | 439/607 |
| 7,273,390 | B2 * | 9/2007 | Iida et al. | 439/494 |
| 7,470,129 | B2 * | 12/2008 | Trout et al. | 439/74 |
| 2003/0060087 | A1 * | 3/2003 | Yi-Tse | 439/660 |
| 2003/0176111 | A1 * | 9/2003 | Iida et al. | 439/660 |
| 2005/0048846 | A1 * | 3/2005 | Suzuki et al. | 439/660 |
| 2005/0085132 | A1 * | 4/2005 | Chai et al. | 439/660 |
| 2005/0118879 | A1 * | 6/2005 | Shimizu | 439/660 |
| 2006/0019545 | A1 * | 1/2006 | Moriyama et al. | 439/660 |

* cited by examiner

HIGH DENSITY CONNECTOR HAVING TWO-LEVELED CONTACT INTERFACE

BACKGROUND OF THE INVENTION

1. Field of the Invention

The present invention relates to a high density connector and particularly to a connector assembly utilizing such high density connectors to create a unique connection interface.

2. Description of Related Art

With electronic device miniaturization and high signal integrity electronic communications becoming more prevalent, the optimization of space usage becomes a significant factor in connector design.

In card edge connectors, it is known to arrange contacts in two levels. U.S. Pat. No. 5,052,936 issued on Oct. 1, 1991 to Biechler et al. exemplifies such a connector. In this design, two arrays of aligned contact members for interfacing either side of a board or card edge are insert molded to a lower subassembly housing which in turn is assembled to an upper housing. The board or card edge is provided with an upper level of contact pads and a lower level of contact pads. When the board or card edge is inserted into the housing, the lower level of contact pads electrically connect with a first array of contact members of the connector and the upper level of contact pads electrically connect with a second array of contact members.

U.S. Pat. No. 7,104,848 issued on Sep. 12, 2006 to Chou et al. discloses an USB (Universal Serial Bus) related electrical connector comprising a plug and a socket mated with the plug. The plug has an array of front contact pins and an array of rear contact pins. The socket also has an array of front contact pins and an array of rear contact pins for electrically connecting with the rear and front contact pins of the plug, respectively.

The above two patents do not disclose how their contact arrangement in two (e.g. upper and lower) levels or in two (e.g. front and rear) arrays can be implemented in a tight space, such as in mezzanine backplane applications where, for example, a daughter board is to be interfaced with a mother board through two interconnected connectors associated with individual (printed circuit) boards. As a further example of one level only interconnection or interface, U.S. Pat. No. 6,981,883 issued on Jan. 3, 2006 to Raistrick et al. discloses an impedance controlled electrical connector, particularly a mezzanine connector, which comprises insert molded leadframe assembly in a split configuration.

U.S. Pat. No. 5,904,581 issued on May 18, 1999 to Pope et al. discloses an electrical interconnection system comprising a female connector and a male connector mated with the female connector. Each of the male and female connectors comprises body walls with contact elements positioned on opposite side faces of the body wall. The contact element may have straight or angled end segments. Generally, for a mating pair of contact elements of the two connectors, one of the mated contact elements has a straight end segment and the other contact element has an angled end segment. Unlike the upper and lower aligned contact members seen in the card edge connector of the mentioned '936 patent, the contact elements on a specific side face of the body wall in this patent does not show aligned contact arrangement nor imply interconnection occurring at two levels.

U.S. Pat. No. 6,371,773 issued on Apr. 16, 2002 to Crofoot et al. discloses a high density interconnect system used in association with printed circuit boards, circuit cards, back panels and other like substrates. Conceiving a need to reduce interference, cross-talk and similar signal degration, and especially to do so in relatively small size connectors while providing relatively high signal density, the interconnect system comprises electrical connector modules each having a plurality of signal conductors substantially parallel within a first plane and a reference conductor element made of a single piece of sheet metal. The reference conductor element includes a plurality of first reference conductors substantially parallel to one another and interspersed between the signal conductors and at least part of which are in the first plane and a plurality of second reference conductors within a second plane which is offset from and substantially parallel to the first plane. The second reference conductor is aligned with the signal conductor in a direction perpendicular to the plane of the connector module. However, when the connector modules of two mating connector portions are mated, curved contact ends of mating signal conductors make a hermaphrodite mating while associated second reference conductors only shield beside the mated signal conductor but not touch each other.

U.S. patent application Ser. No. 11/818,100 filed on Jun. 13, 2007 and assigned to the same assignee as the present invention also discloses a USB-related contact mating interface which occurs at two levels. However, like above-mentioned prior art patents, there is not any discussion as to how the unique two-level mating interface can be exploited or modified to be used in high density connector applications, in combination with other feature or features as will be apparent from the detailed description and claims below.

SUMMARY OF THE INVENTION

An object of the present invention is to provide a terminal arrangement in an electrical connector, comprising: an array of terminal pairs arranged along a first direction, each terminal pair comprising a first terminal and a second terminal, each of the first terminal and the second terminal having a portion angled toward the other terminal, a connecting end continuing the angled portion, and a terminating end opposite the connecting end, the connecting ends of the first and second terminals of each terminal pair being substantially aligned to each other in a second direction perpendicular to the first direction, the connecting end of the first terminal having a mating face facing away from the second terminal, the connecting end of the second terminal having a mating face facing toward the first terminal, the mating faces of the first and second terminals being spaced a distance from each other in the second direction.

Another object of the present invention is to provide an electrical connector comprising: a housing; and a first and a second terminal modules secured to the housing, the first terminal module being disposed adjacent to the second terminal module with a void space therebetween, each terminal module comprising an array of terminal pairs arranged along a first direction, each terminal pair comprising a first terminal and a second terminal substantially aligned to each other in a second direction perpendicular to the first direction, each of the first terminal and the second terminal having a connecting end and a terminating end opposite the connecting end, the connecting ends of the first and second terminals of each terminal pair being substantially aligned to each other in a second direction perpendicular to the first direction, each of the connecting ends of the first and second terminals having a mating face directed in a third direction orthogonal to both the first and the second directions, the mating faces of the terminal connecting ends of one terminal module being exposed to the void space.

Still another object of the present invention is to provide an electrical connector system comprising: a first connector defining a mating direction, the first connector comprising a housing and an array of terminal pairs arranged in the housing along a first direction, each terminal pair comprising a first terminal and a second terminal, each terminal having a connecting end, the connecting end of the first terminal of a pair of terminals being positioned alignedly forwardly of the connecting end of the second terminal of the pair of terminals along the mating direction, each terminal having a mating face facing toward a second direction vertical to the first direction; and a second connector defining a mating direction, the second connector comprising a housing and an array of terminal pairs arranged in the housing along the first direction, each terminal pair comprising a first terminal and a second terminal, each terminal having a connecting end, the connecting end of the first terminal of a pair of terminals being positioned alignedly forwardly of the connecting end of the second terminal of the pair of terminals, each terminal having a mating face facing toward the second direction, the mating face of the first terminal of the second connector engaging the mating face of the second terminal of the first connector and the mating face of the second terminal of the second connector engaging the mating face of the first terminal of the first connector.

Other objects, advantages and novel features of the invention will become more apparent from the following detailed description of a preferred embodiment when taken in conjunction with the accompanying drawings.

DETAILED DESCRIPTION OF THE INVENTION

Figure 1:
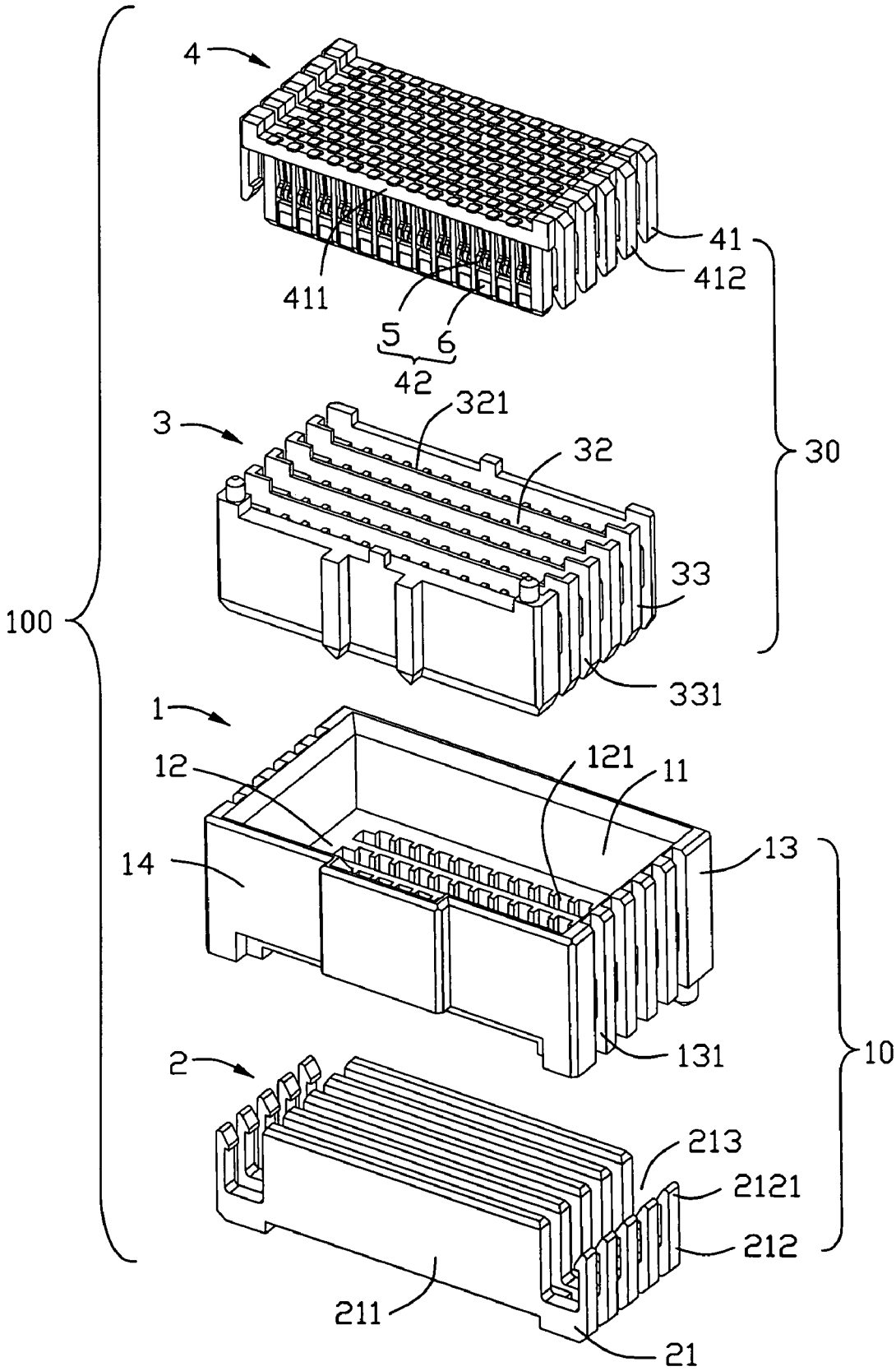
FIG. 1 is an exploded perspective view of a connector assembly in accordance with a first embodiment of the present invention.

Reference will now be made to the drawing figures to describe the present invention in detail. Referring to FIGS. 1-6, a high density mezzanine connector assembly 100 in accordance with the preferred embodiment of the present invention comprises a first connector 10 and a second mating connector 30. The first connector 10 is shown as a female connector in view of its housing structure and will be so called in the following description. Similarly, since the second connector 30 is shown as a male connector in view of its interface housing structure, it will be so called in the following description for ease of reference and clarity, but not in the sense of limiting.

Referring to FIGS. 1-4, the female connector 10 comprises a rectangular female housing 1 defining a receiving cavity 11 and a plurality of terminal modules 2 in the receiving cavity 11 of the female housing 1. The female housing 1 is formed with a bottom wall 12 defining a plurality of slots or channels 121, a pair of primary walls 14, and a pair of periphery walls 13 extending upwardly from the bottom wall 11 for surrounding the receiving cavity 11. Each periphery wall 13 has a plurality of fixing recesses 131 defined on an outer surface thereof along a top-to-bottom direction. The terminal modules illustrate an example of a suitable structure that enables terminals to be conveniently mounted relative to the housing. As will be apparent from a reading of the disclosed and claimed invention, instead of a modular design where terminals are retained to insulative housing by insert molding to form contact wafers, lead frames or modules, the housing itself can be designed in such a way that all or part of the terminals are directly inserted or stitched thereto without departing from the invention.

Figure 7:
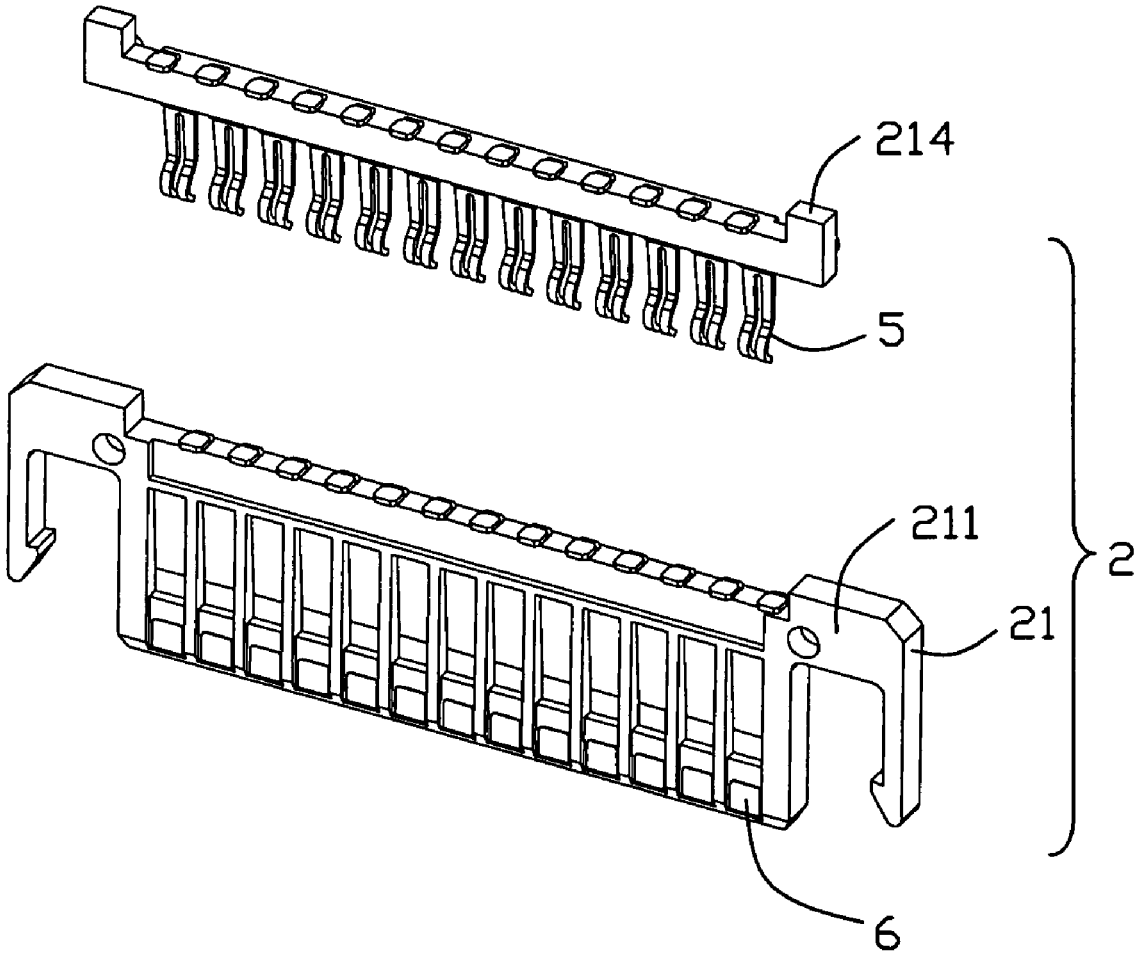
FIG. 7 is a partially exploded view of a terminal module.
Figure 12:
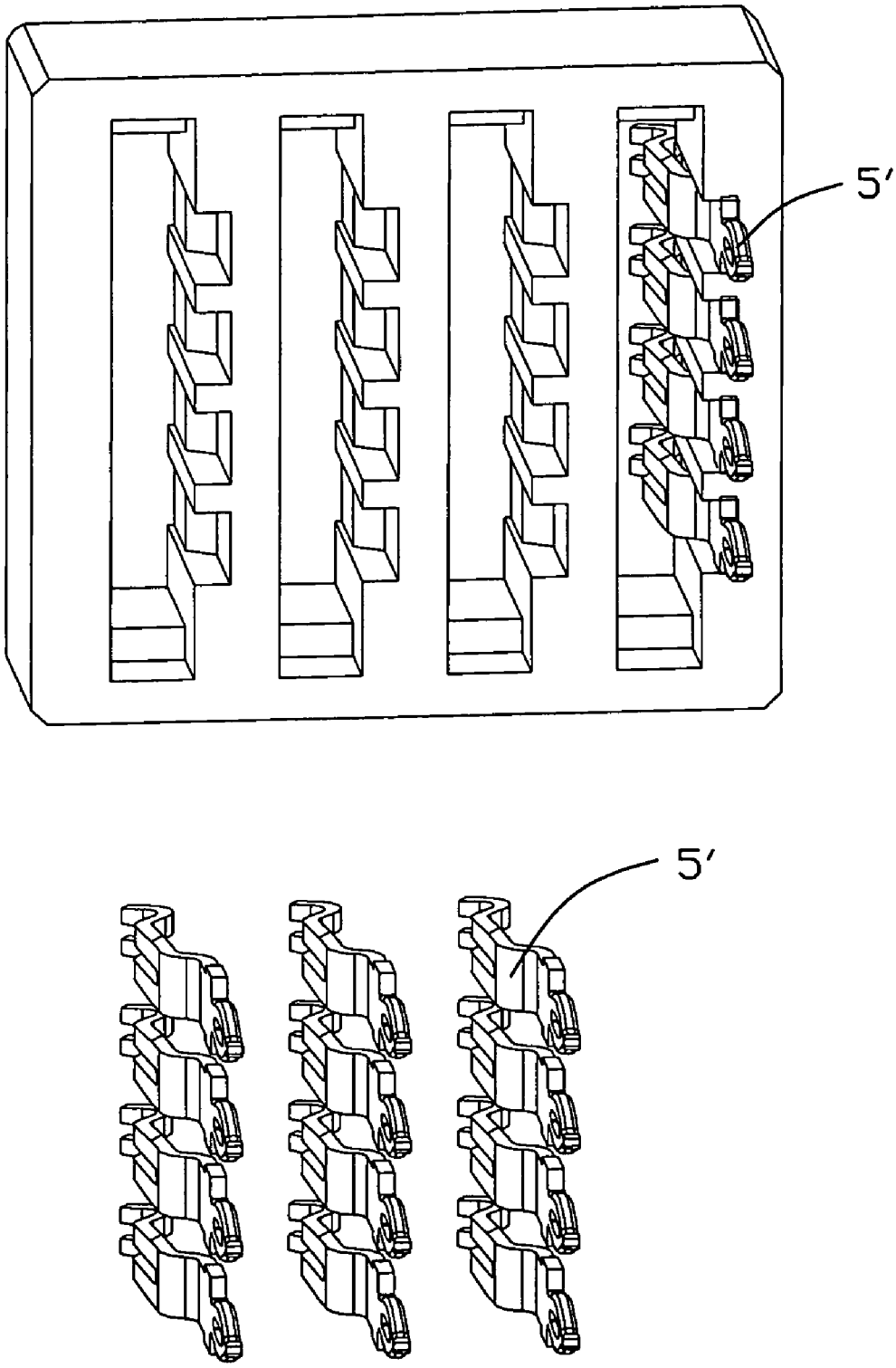
FIGS. 12-14 are perspective views showing the housing and terminal module for receiving terminals in a second embodiment.
Figure 13:
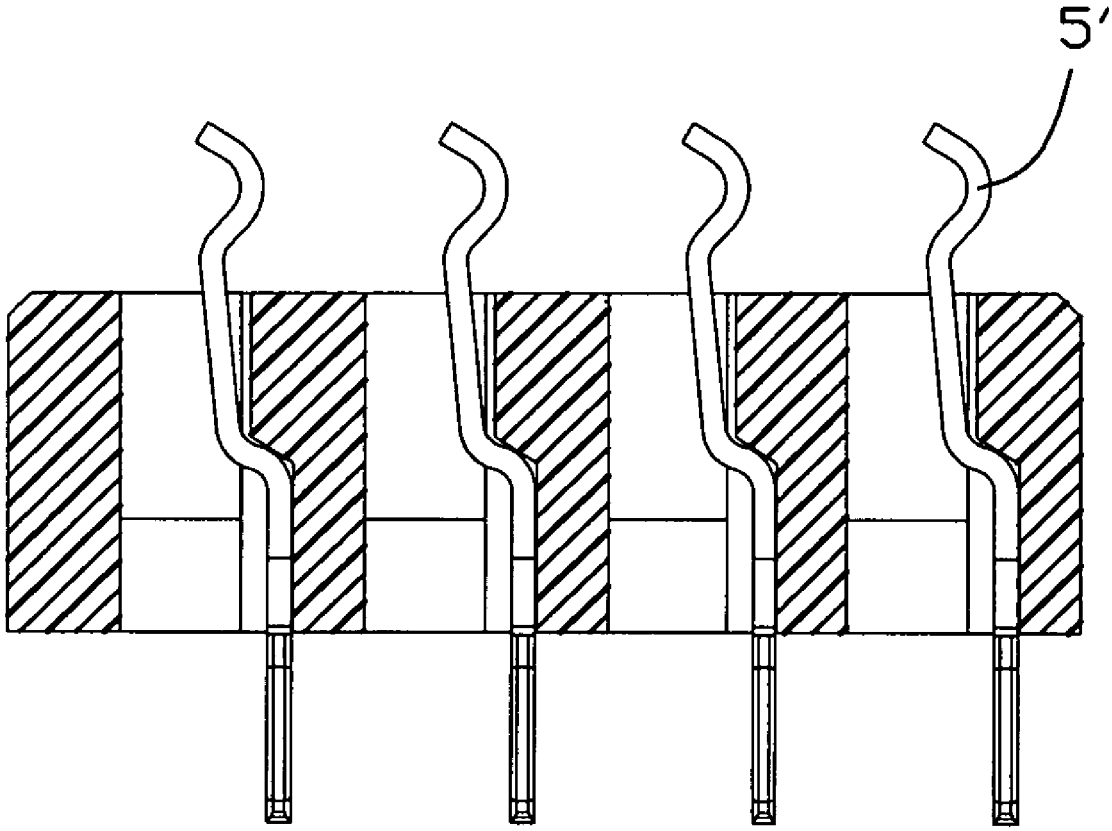
Figure 14:
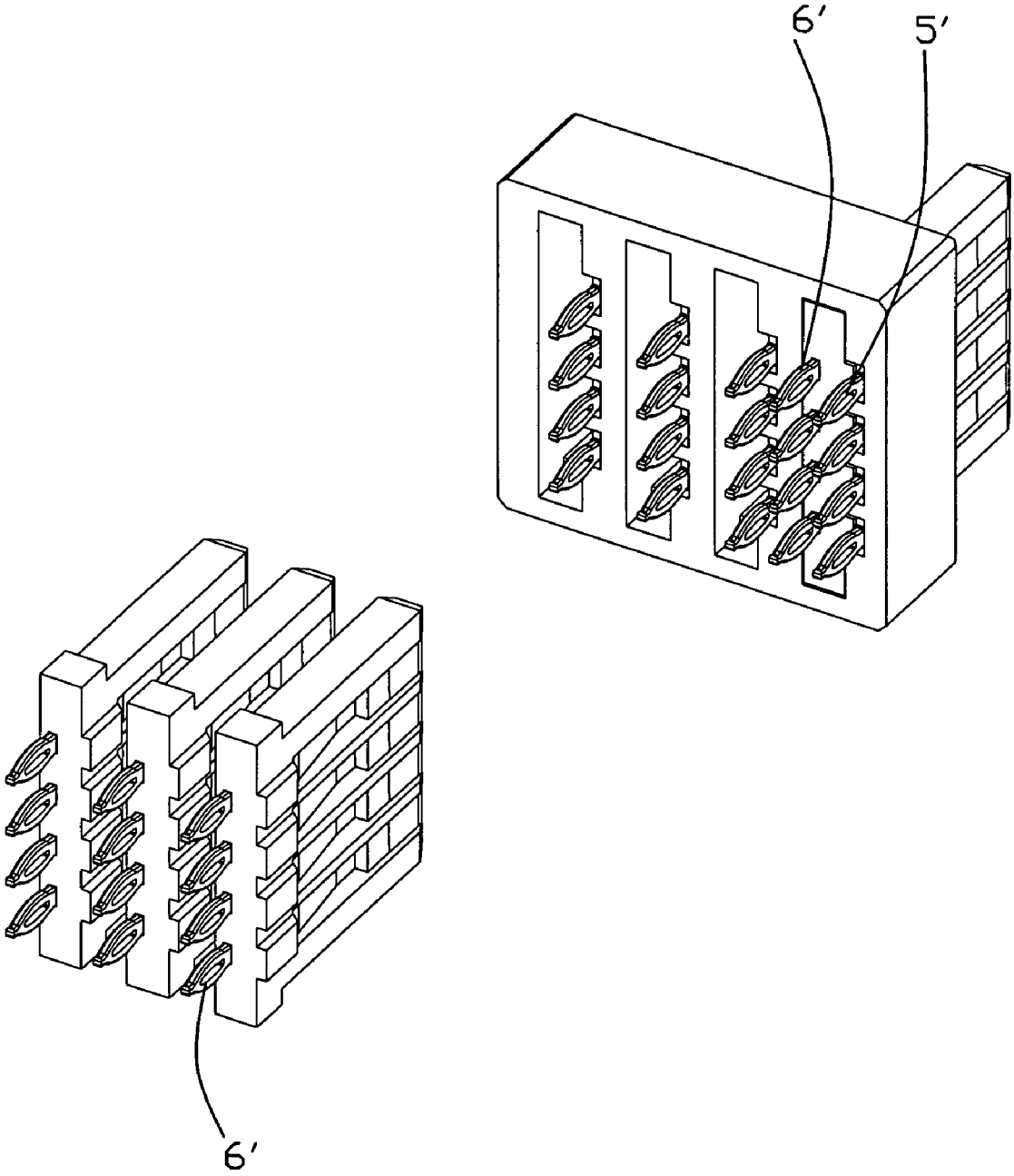

In conjunction with FIG. 7, in this embodiment, each terminal module 2 comprises two leadframe housings 21 and 214 and an array of terminal pairs 22 mounted along the leadframe housings. The two leadframe housings may be suitably mounted together, for example, through pegs and holes. One leadframe housing 21 has a pair of fixing beams 212 symmetrically formed at two opposite ends thereof. A cutout 213 is defined between each fixing beam 212 and a main body 211 of the housing 21 for accommodating the periphery wall 13. Each fixing beam 212 has a hook 2121 formed at a free end thereof. In conjunction with FIG. 9, each female terminal pair 22 has a first terminal 5 retained to the leadframe housing 214 and a second terminal 6 retained to the leadframe housing 21. The first and second terminals 5 and 6 are preferably retained to associated leadframe housings by insert molding. However, inserting or stitching the terminals directly to the housing, modified as appropriate, is contemplated. FIGS. 12-14 show such a varied design of the housing and terminal module for receiving terminals in a second embodiment.

The male connector 30 comprises a male housing 3 defining a receiving cavity 31 and a plurality of male terminal modules 4 retained to the housing 3 in the retaining cavity 31. The female and male terminal modules 2 and 4 are similarly constructed, at least as to their mating interface, as will be detailed later. The male housing 3 also has a configuration similar to the that of the female housing 1 and comprises a base or bottom wall 32 defining a plurality of channels or slots 321 and a pair of side walls 33 defining a plurality of engaging recesses 331.

Figure 8:
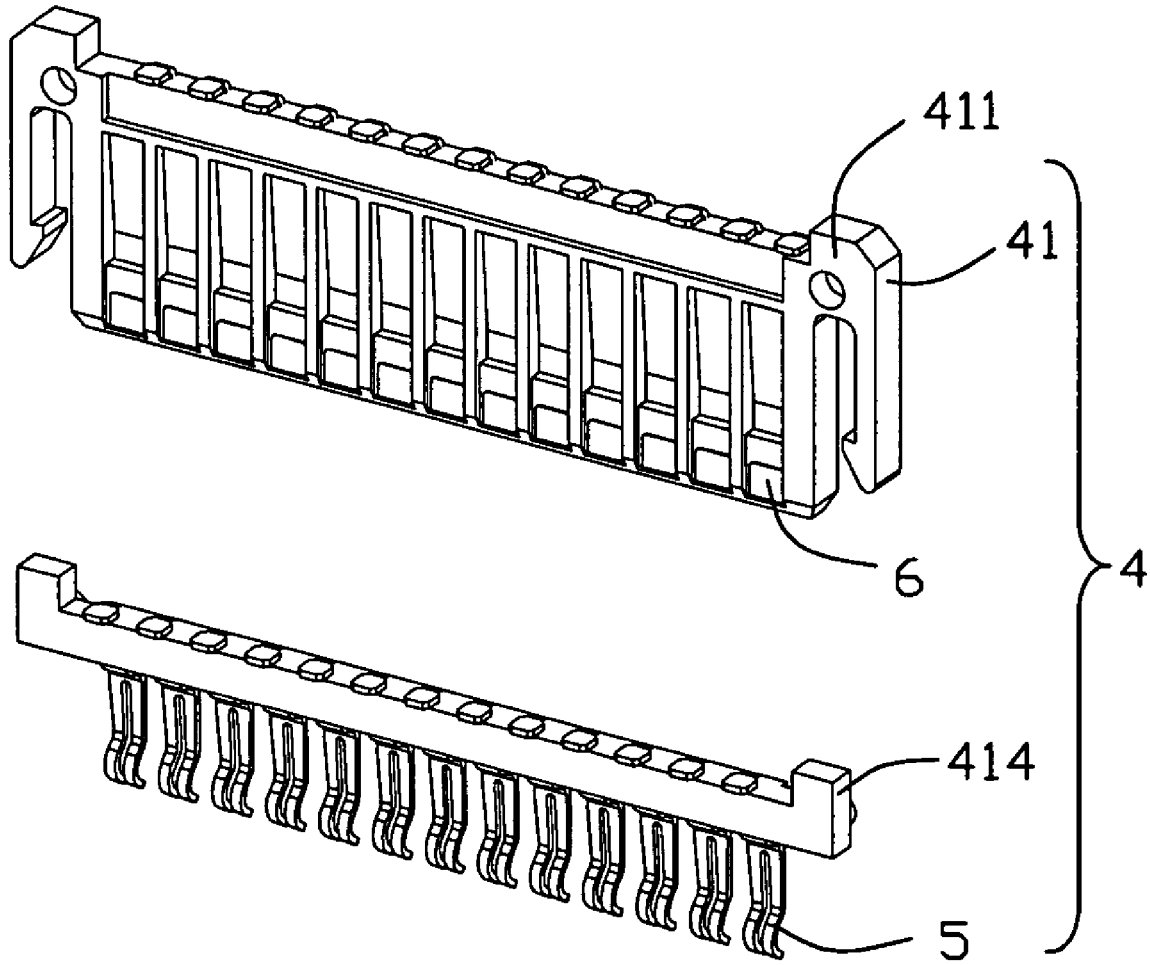
FIG. 8 is a partially exploded view of a male terminal module.

In conjunction with FIG. 8, each male terminal module 4 comprises two leadframe housings 41 and 414 and a plurality of male terminal pairs 42 mounted along the leadframe housings. The leadframe housing 41 has a configuration similar to that of the leadframe housing 21 and comprises a base portion 411 and a pair of engaging beams 412. In conjunction with FIG. 9, each male terminal pair 42 has a first terminal 5 retained to the leadframe housing 414 and a second terminal 6 retained to the base portion 411.

Figure 9:
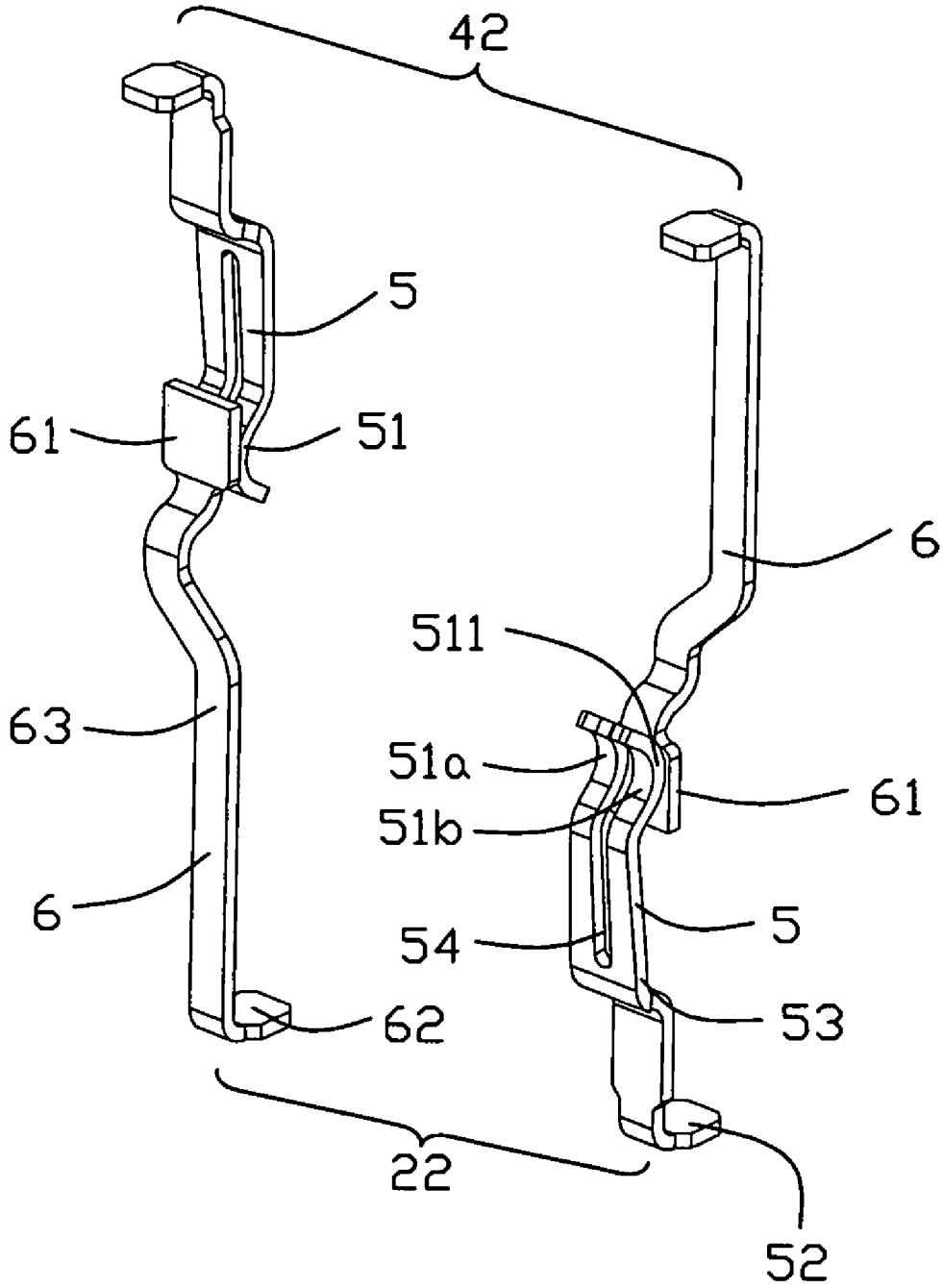
FIG. 9 is an enlarged perspective view showing a terminal pair mating with a male terminal pair.
Figure 10:
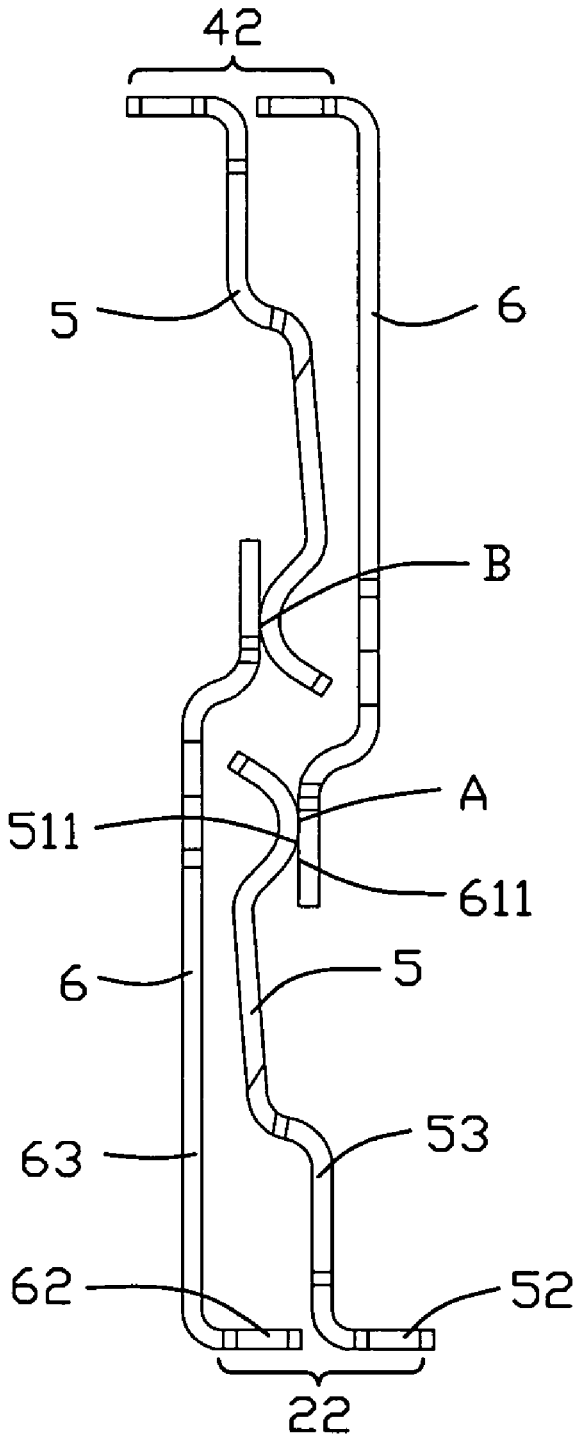
FIG. 10 is a schematic view showing the terminal pair mating with corresponding male terminal pair.

In conjunction with FIGS. 9 and 10, each female terminal pair 22 and each mating male terminal pair 42 are hermaphroditic relative to each other. The first terminal 5 comprises a connecting end 51 having a curved mating face 511, a terminating end 52, and a contact beam 53 connecting the contact end 51 and the soldering portion 52. The first terminal 5 defines a slit 54 extending in the connecting end 51 to form two branches 51*a* and 51*b*.

The second terminal 6 comprises a connecting end 61 having a flat mating face 611, a terminating end 62, and a connecting beam 63 connecting the connecting end 61 and the terminating 62. The connecting beam 63 has two angled portions.

Figure 2:
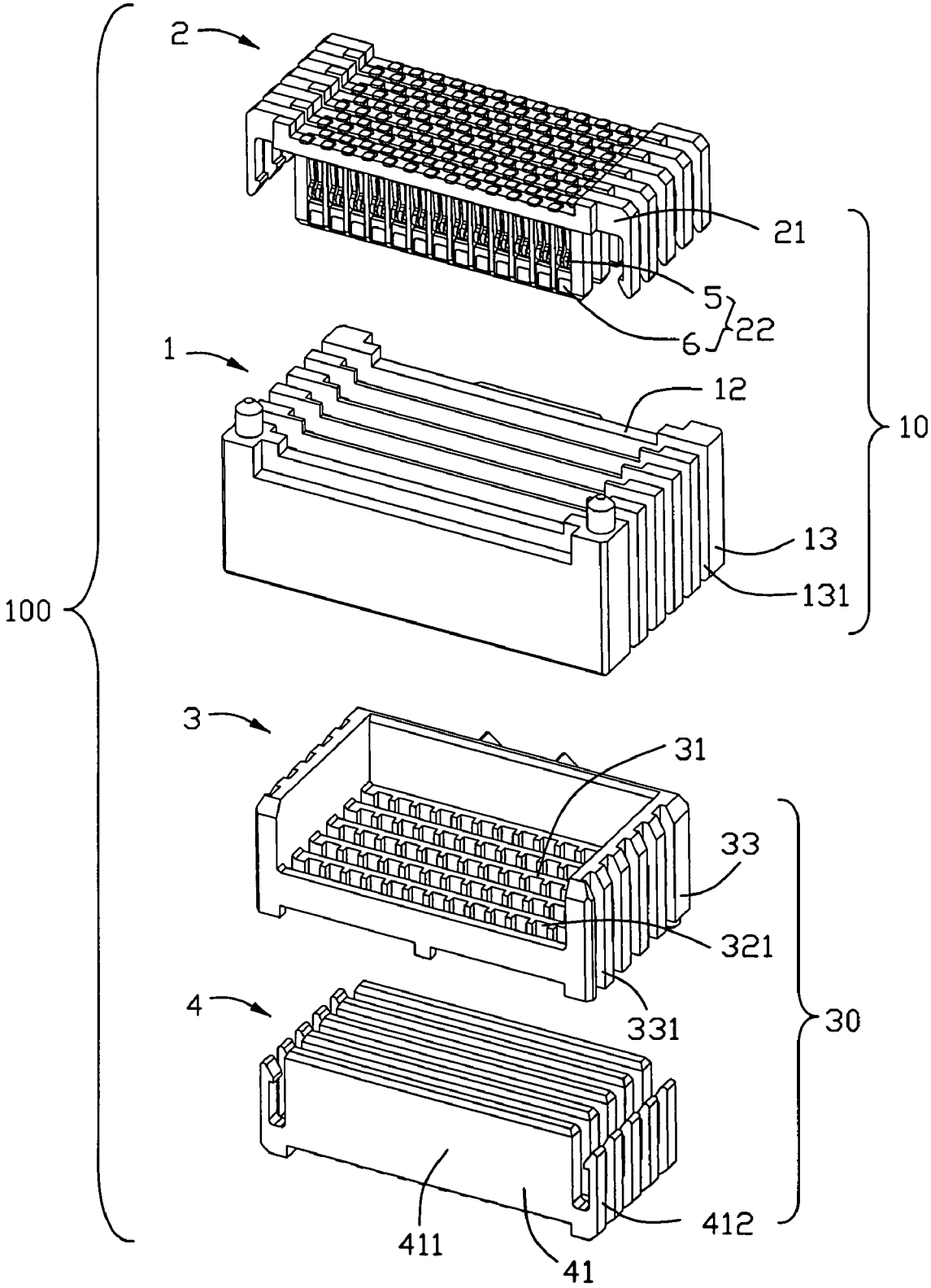
FIG. 2 is another exploded perspective view similar to FIG. 1, taken from another aspect.

Referring to FIGS. 1-2, the first terminal 5 and the second terminal 6 are formed as a female terminal pair 22 or a male terminal pair 42. The female and male terminal pairs 22, 42 are respectively mounted along their leadframe housings 21, 41. The connecting beam 63 of the second terminal 6 is embedded in the female plate 21, with the connecting end 61 exposed to the outside. The connecting beam 63 of the second terminal 6 has a length longer than that of the contact beam 53 of the first terminal 5 to position the connecting end 61 forwardly of the contact end 51 within each terminal pair. The terminating end 52 of the first terminal 5 has a soldering portion leveled with a soldering feet of the terminating end 62 of the second terminal 6 in each terminal module.

Figure 3:
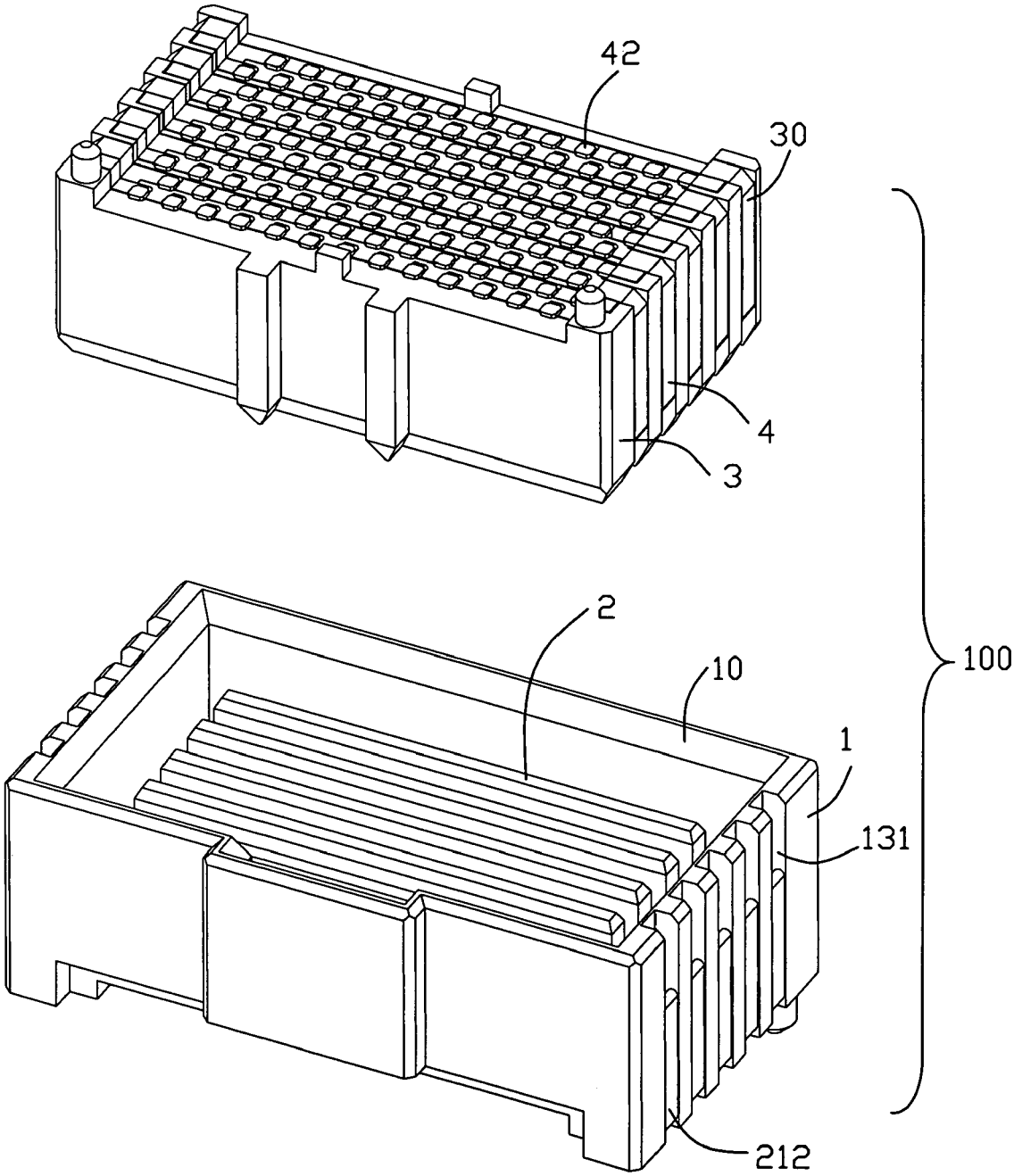
FIG. 3 is a perspective view showing an assembled first connector not mating with an assembled second connector.
Figure 4:
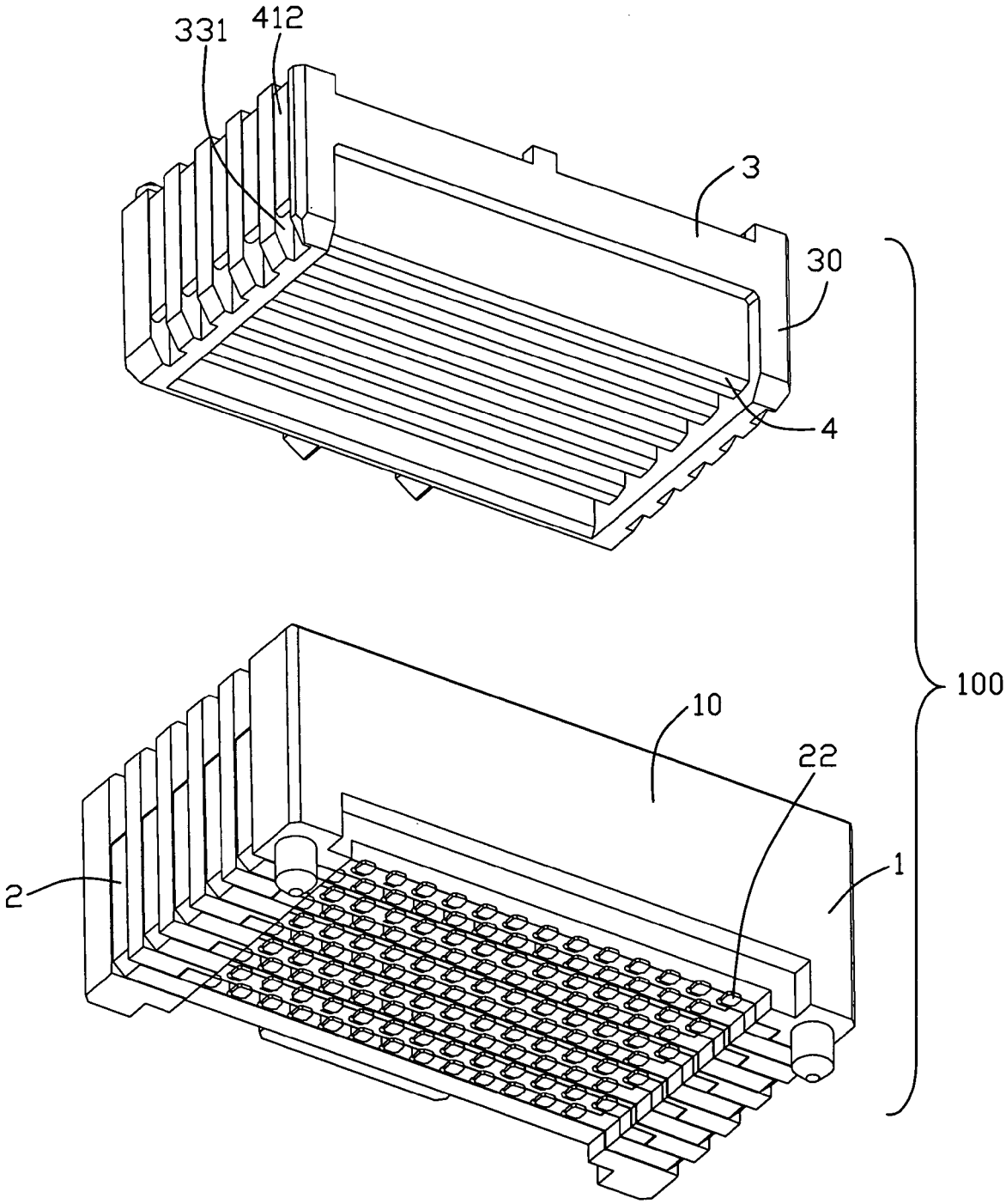
FIG. 4 is another perspective view showing the assembled first connector not mating with the assembled second connector, taken from another aspect.
Figure 5:
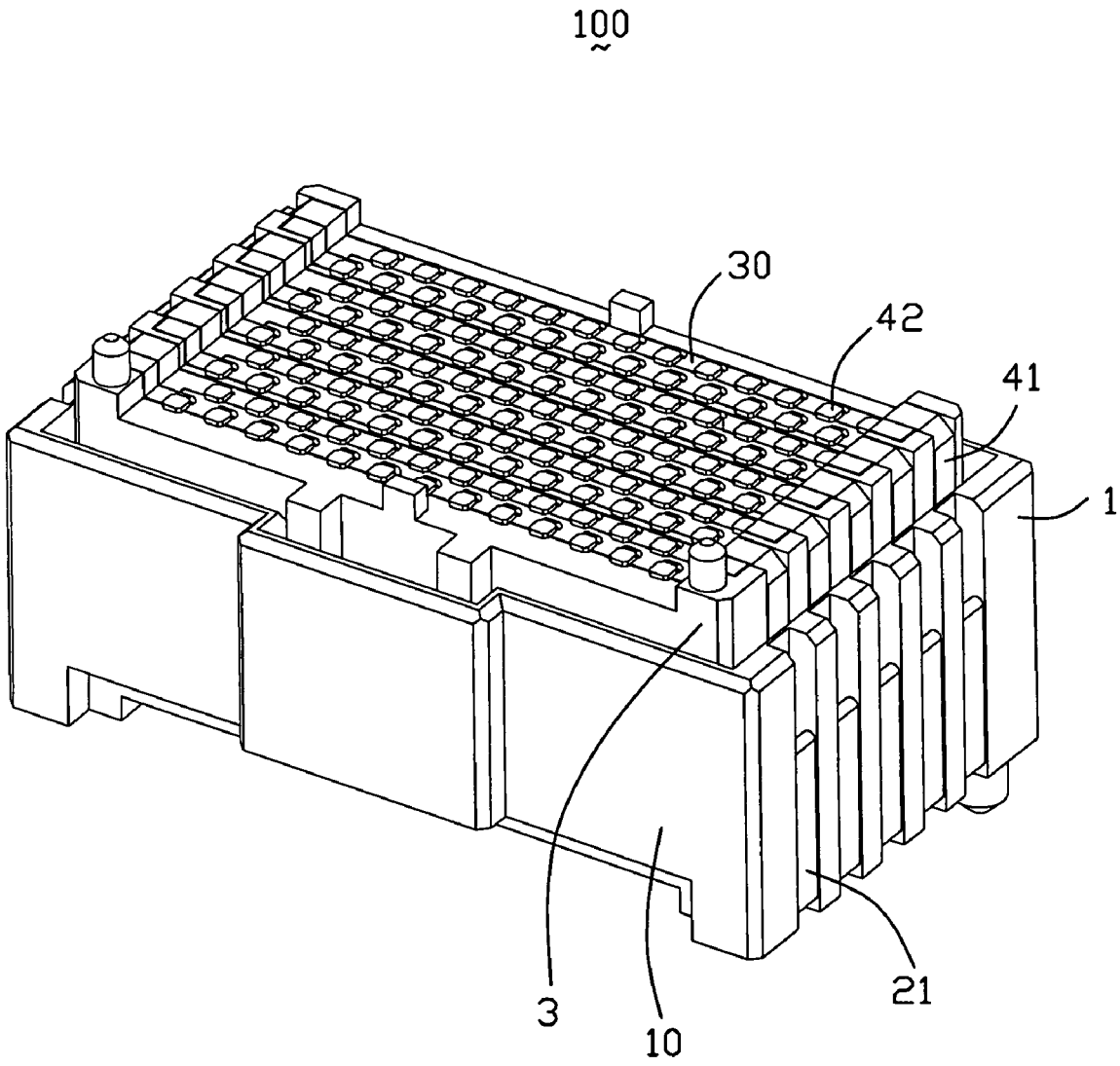
FIG. 5 is an assembled perspective view of the connector assembly as shown in FIG. 1.
Figure 6:
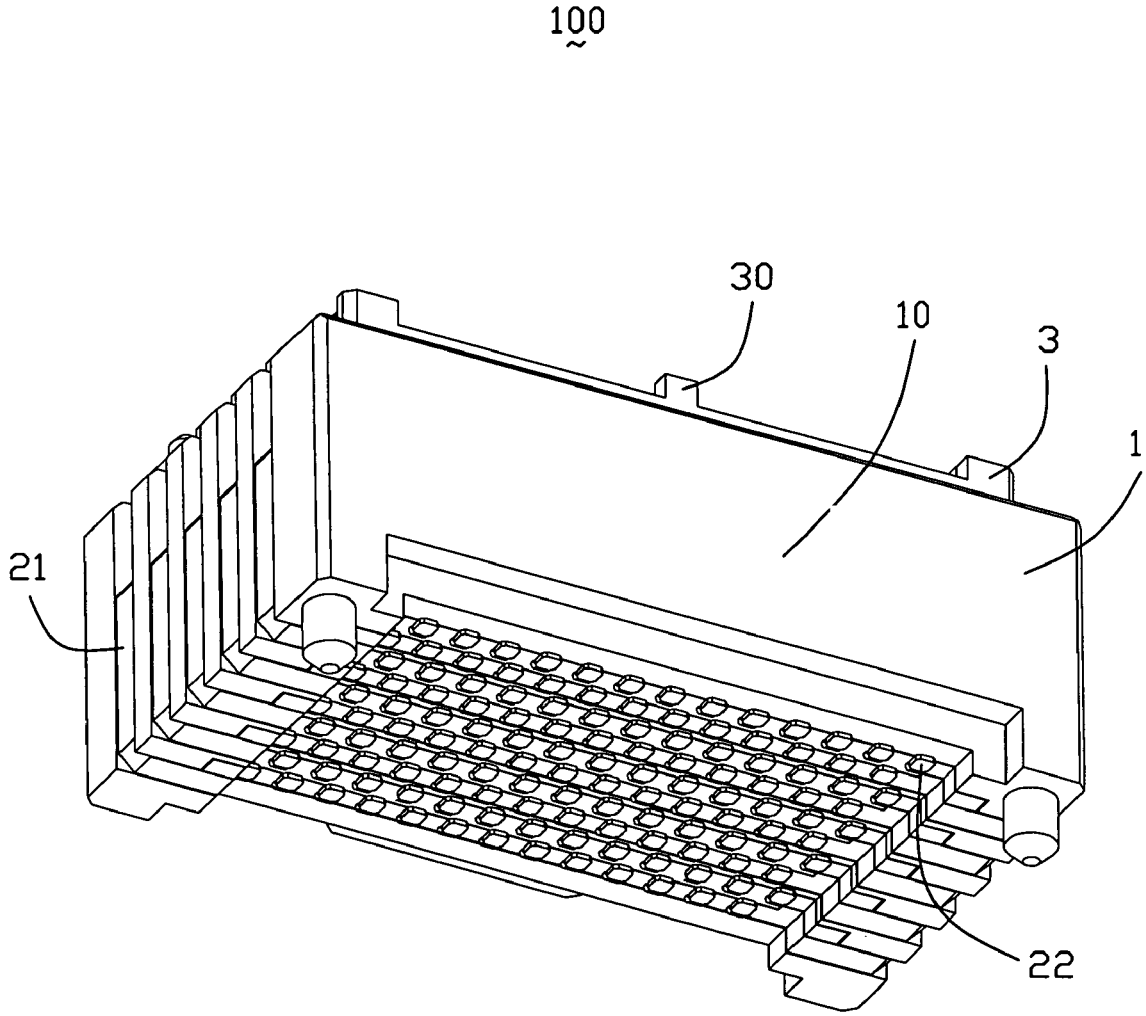
FIG. 6 is another assembled perspective view of the connector assembly as shown in FIG. 5, taken from another aspect.

Referring to FIGS. 3-4, in assembling of the female connector 10, the terminal modules 2 are inserted into the receiving cavity 11 of the female housing 1 from a bottom thereof, with the body portion 211 inserted into the receiving cavity 11 through the slots 121 and the fixing beams 212 inserted in the fixing recesses 131. In assembling of the male connector 30, the terminal modules 4 are inserted into the retaining cavity 31 of the male housing 3 from a bottom thereof, with the base portions 411 inserted through channels 321 and the engaging beams 412 inserted in the engaging recesses 331.

Figure 11:
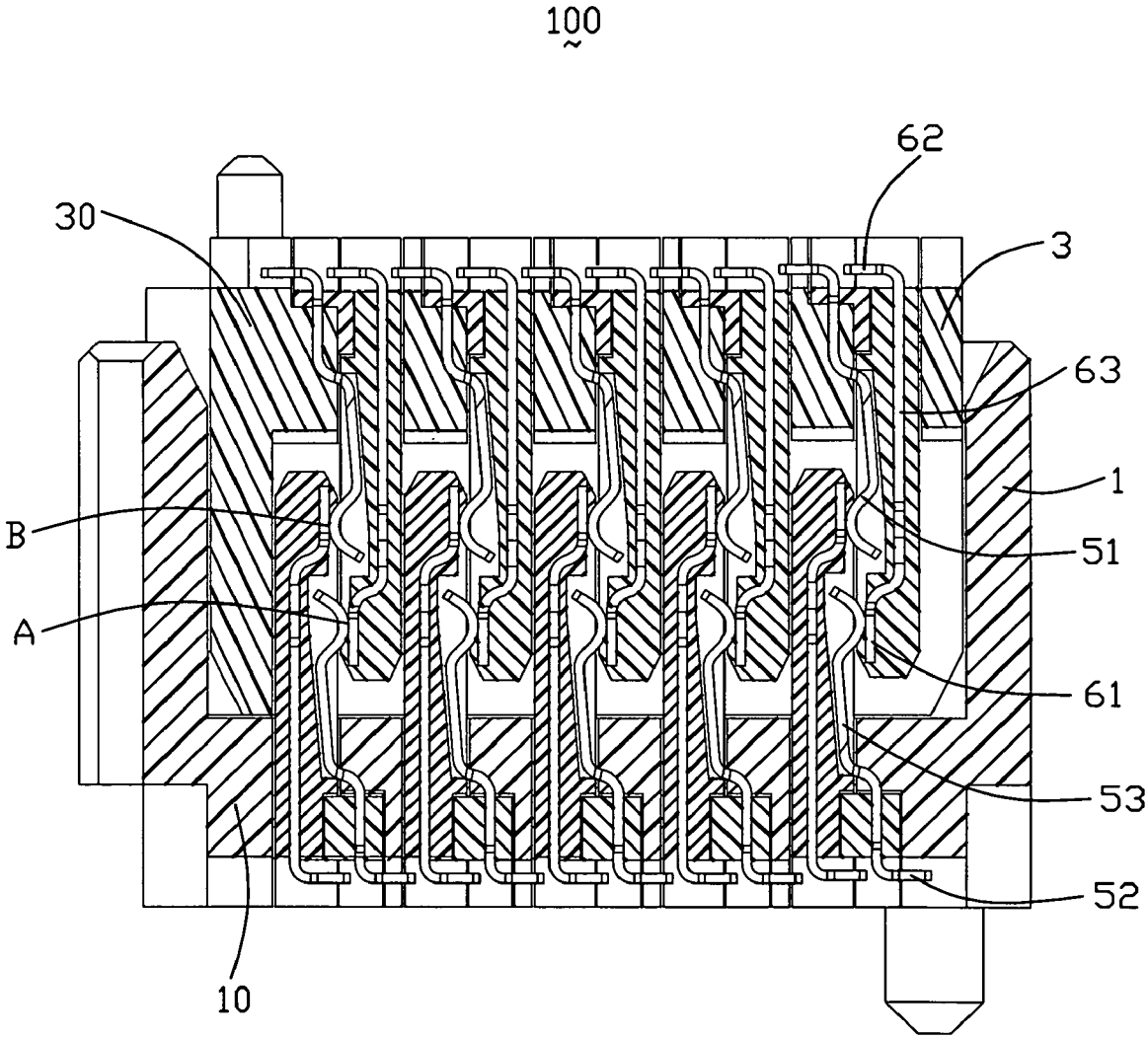
FIG. 11 is a schematic view showing the terminal pairs in the first connector engaging with the male terminal pairs in the male connector.

Referring to FIG. 11, when the male connector 30 is mated with the female connector 10 along the mating direction, the male housing 3 is partially entering the receiving cavity 11 of the female connector 10, with the female terminal modules 2 inserted into the retaining cavity 31. The female terminal pairs 22 and corresponding male terminal pairs 42 come to mated with each other, with the curved contact face 511 of the first terminal 5 slides along and mates the flat connecting face 611 of corresponding mated second terminal 6.

In conjunction with FIGS. 10 and 11, when the female terminal pair 22 is mated with corresponding male terminal pair 42, the first terminal 5 is substantially aligned with corresponding mated inverted second terminal 6, with the contact end 51 of the first terminal 5 in contact with the inverted connecting end 61 of the second terminal 6 at a first position A, and with the connecting end 61 of the second terminal 6 in contact with the contact end 51 of corresponding mated inverted first terminal 5 at a second position B. The first position A and the second position B are disposed at two different levels and are substantially aligned with each other along the mating direction. The connecting end 51 of the first terminal 5 of the female connector 10 and the connecting end 51 of the first terminal 5 of the male connector 20 are partially overlapped along the mating direction, and are spaced apart along a transverse direction perpendicular to the mating direction. As can be understood, the mating first and second terminals from the two mating modules can be suitably designated as either signal or ground contacts as desired.

The connecting end 51 of the first terminal 5 and the connecting end 61 of corresponding mated second terminal 6 are presented to mate each other. Also, the mating face of the connecting end 51 of the first terminal 5 and the mating face of the connecting end 61 of the second terminal 6 in a terminal pair face toward a same direction. A transverse distance between the first position A and the second position B is smaller than a transverse distance between a lower end of the contact beam 53 and a lower end of the adjacent connecting beam 63. The soldering portions 52 and the soldering feet 62 extend toward a same direction in a same connector, and extend toward opposite directions in the female and male connectors 10, 30. The contact beam 53 of the first terminal 5 and the connecting beam 63 of the second terminal 6 has a respective angled portion so that the connecting ends in a terminal pair are brought closer to each other.

The connecting end 51 of the female terminal pair 22 comes to contact with the connecting end 61 of the male terminal pair 42 at the first position A. The connecting end 61 of the female terminal pair 22 comes to contact with the contact end 51 of the male terminal pair 42 at the second position B. Two electrical paths have been established; one electrical path may be used for grounding and the other may be used for transferring signal. The first position A and the second position B are disposed at two different levels and are substantially aligned with each other along the mating direction so that the space taken up in such contact interface arrangement will not extend beyond to occupy the space intended for adjacent modules. Therefore, the space occupied by the hermaphroditic terminals, i.e., first and second terminals, has been made of efficient use.

The disclosure is illustrative only, changes may be made in detail, especially in matter of shape, size, and arrangement of parts within the principles of the invention.

What is claimed is:

1. An electrical connector system comprising:

a first connector defining a mating direction, the first connector comprising a housing and an array of terminal pairs arranged in the housing along a first direction, each terminal pair comprising a first terminal and a second terminal, each terminal having a connecting end, the connecting end of the first terminal of a pair of terminals being positioned in-line forwardly of the connecting end of the second terminal of the pair of terminals along the mating direction, each terminal having a mating face facing toward a second direction vertical to the first direction; and a second connector defining a mating direction, the second connector comprising a housing and an array of terminal pairs arranged in the housing along the first direction, each terminal pair comprising a first terminal and a second terminal, each terminal having a connecting end, the connecting end of the first terminal of a pair of terminals being positioned in-line forwardly of the connecting end of the second terminal of the pair of terminals, each terminal having a mating face facing toward the second direction, the mating face of the first terminal of the second connector engaging the mating face of the second terminal of the first connector and the mating face of the second terminal of the second connector engaging the mating face of the first terminal of the first connector.

2. The electrical connector system as claimed in claim 1, wherein the first terminals of each of the first and second connectors are insert molded with a first insulative housing part and the second terminals of each of the first and second connectors are insert molded with a second insulative housing part, and the first insulative housing part is attached to the second insulative housing part.

3. The electrical connector system as claimed in claim 2, wherein:

the housing of each connector comprises a bottom wall and defines a cavity;

the first insulative housing part engages a bottom of the bottom wall; and the second insulative housing part extends beyond the bottom wall into the cavity of the housing.

4. The electrical connector system as claimed in claim 3, wherein:

each of the first and second connectors comprises at least two arrays of terminal pairs;

the second insulative housing part comprises a flat wall face; and the flat wall face of at least one second insulative housing part of one of the first and second connectors is flush with the flat wall face of at least one second insulative housing part of the other connector.

* * * * *